US005524561A

United States Patent [19]

Schueler et al.

[11] Patent Number: 5,524,561

[45] Date of Patent: Jun. 11, 1996

[54] BUTTONHOLE SEWING MACHINE

[75] Inventors: Peter K. Schueler, Hawthorne; Pedro Silva, Carteret, both of N.J.

[73] Assignee: Clinton Industries, Inc., Carlstadt, N.J.

[21] Appl. No.: 311,784

[22] Filed: Sep. 23, 1994

[51] Int. Cl.[6] ..... D05B 3/06

[52] U.S. Cl. ..... 112/67

[58] Field of Search ..... 112/70, 65, 73, 112/76, 66, 67, 68, 446, 447, 470.05, 475.25, 470.06

[56] References Cited

U.S. PATENT DOCUMENTS 4,181,083 1/1980 Bajer et al. ..... 112/70 X
4,495,878 1/1985 Asai et al. .
4,502,401 3/1985 Asai et al. .
4,696,245 9/1987 Kato et al. .
4,712,496 12/1987 Brown et al. .
4,759,302 7/1988 Yanagi ..... 112/470.06 X
5,125,349 6/1992 Koie et al. ..... 112/68 X
5,222,449 6/1993 Koie et al. .

*Primary Examiner*—Peter Nerbun
*Attorney, Agent, or Firm*—Darby & Darby

[57] ABSTRACT

A buttonhole sewing machine includes a housing. A bed plate is slidably mounted on the housing and moves between a home position and a sew position. A needle mechanism is mounted on the housing and is movable in a reciprocal manner with respect to the housing, A first motor is mounted on the housing. The first motor directly drives the bed plate between the home position and the sew position. A second motor is mounted on the housing. The second motor directly drives the needle mechanism.

10 Claims, 6 Drawing Sheets

BUTTONHOLE SEWING MACHINE

FIELD OF THE INVENTION

The present invention relates to a buttonhole sewing machine. More specifically, the present invention relates to a buttonhole sewing machine having a first motor to directly drive the bed plate and a second motor to directly drive the needle mechanism.

BACKGROUND OF THE INVENTION

Buttonhole sewing machines per sé are known. For example, a buttonhole sewing machine is currently available from the Reece Corporation of Gorham, Me. and is sold under the name "Buttonhole Sewing Machine Series 104-100". The service manual and parts list for this series 104-100 buttonhole sewing machine are hereby incorporated by reference.

This buttonhole sewing machine is driven by a single motor. Because only one motor is used, complex machinery is required to actuate both the bed plate and the needle bar mechanism. For example, the Reece 104-100 buttonhole sewing machine uses two clutches to cause the motor to engage either the bed plate or the needle bar mechanism. Additionally, a brake is required so that the sewing lead can be maintained in a predetermined fixed position.

Because the Reece 104-100 buttonhole sewing machine utilizes complex machinery, it operates at a relatively high noise level and is subject to significant downtime whenever maintenance is required. Parts such as clutches and brakes will inherently wear down over time and must be replaced on a regular basis. However, due to the complex machinery a generally qualified machinery mechanic does not have the necessary skills required to replace the clutches the brake in this buttonhole sewing machine in a satisfactory amount of time. Accordingly, a specially skilled mechanic, who is familiar with the Reece 104-100 machine, is required to replace either the clutches, brake or other components in the Reece 104-100 machine.

Clearly, there is a need in the art to provide a buttonhole sewing machine which is subject to less downtime and operates at a relatively quiet noise level. To meet this need, Reece has attempted to modify their buttonhole sewing machine to overcome some of these problems. One attempt included using a reversible motor that included a pair of one-way clutches attached to it. One one-way clutch was used to drive the bed plate and the other one-way clutch was used to drive the needle bar mechanism. However, in order for this machine to operate properly a brake was required to stop the motor within 3 degrees of accuracy. Unfortunately, after only a relatively short period of use the brake could no longer stop the motor within the required 3 degrees of accuracy. Thus, this modified Reece 104-100 machine resulted in a buttonhole sewing machine that required more maintenance and had even larger amounts of downtime.

SUMMARY OF THE INVENTION

It is an object of the invention to create a buttonhole sewing machine which eliminates the need to use or brakes to drive the bed plate or the needle bar mechanism. Additionally, it is further object of the present invention to provide a buttonhole sewing machine that requires less maintenance and is subject to less downtime and operates at a lower noise level.

In accordance with a embodiment demonstrating further objects, features and advantages of the a buttonhole sewing machine includes a housing with a bed plate being slidably mounted the housing such that the bed plate moves between a home position and a sew position. A mechanism is mounted on the housing and is movable in a reciprocal manner with respect to the housing. A first motor is mounted on the housing. The first motor directly drives bed plate between the home position and the sew position. A second motor is also mounted on the housing. The second motor directly drives the needle mechanism.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE EXEMPLARY EMBODIMENTS

Figure 1:
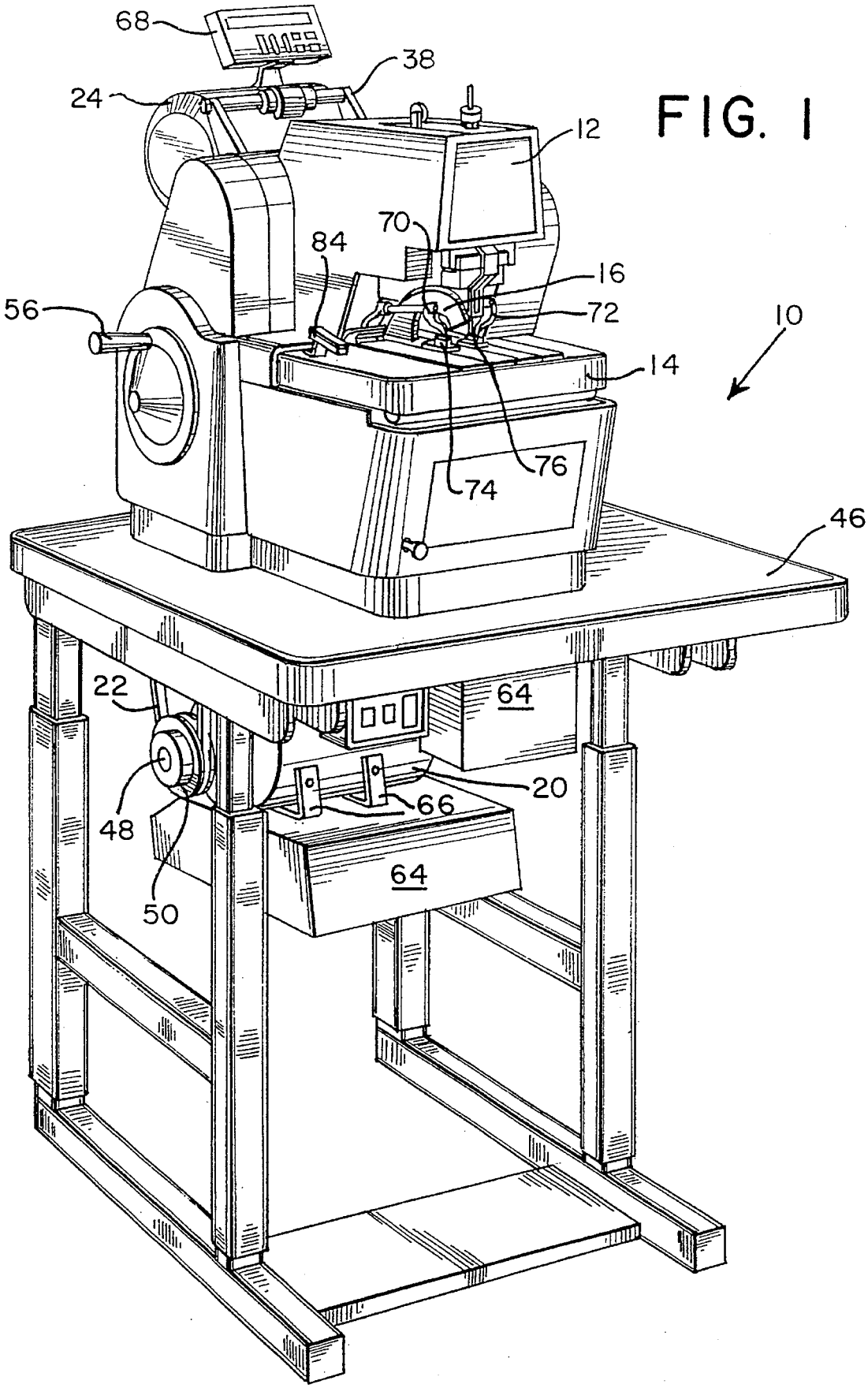
FIG. 1 is a perspective view of a buttonhole sewing machine according to the present invention.
Figure 2:
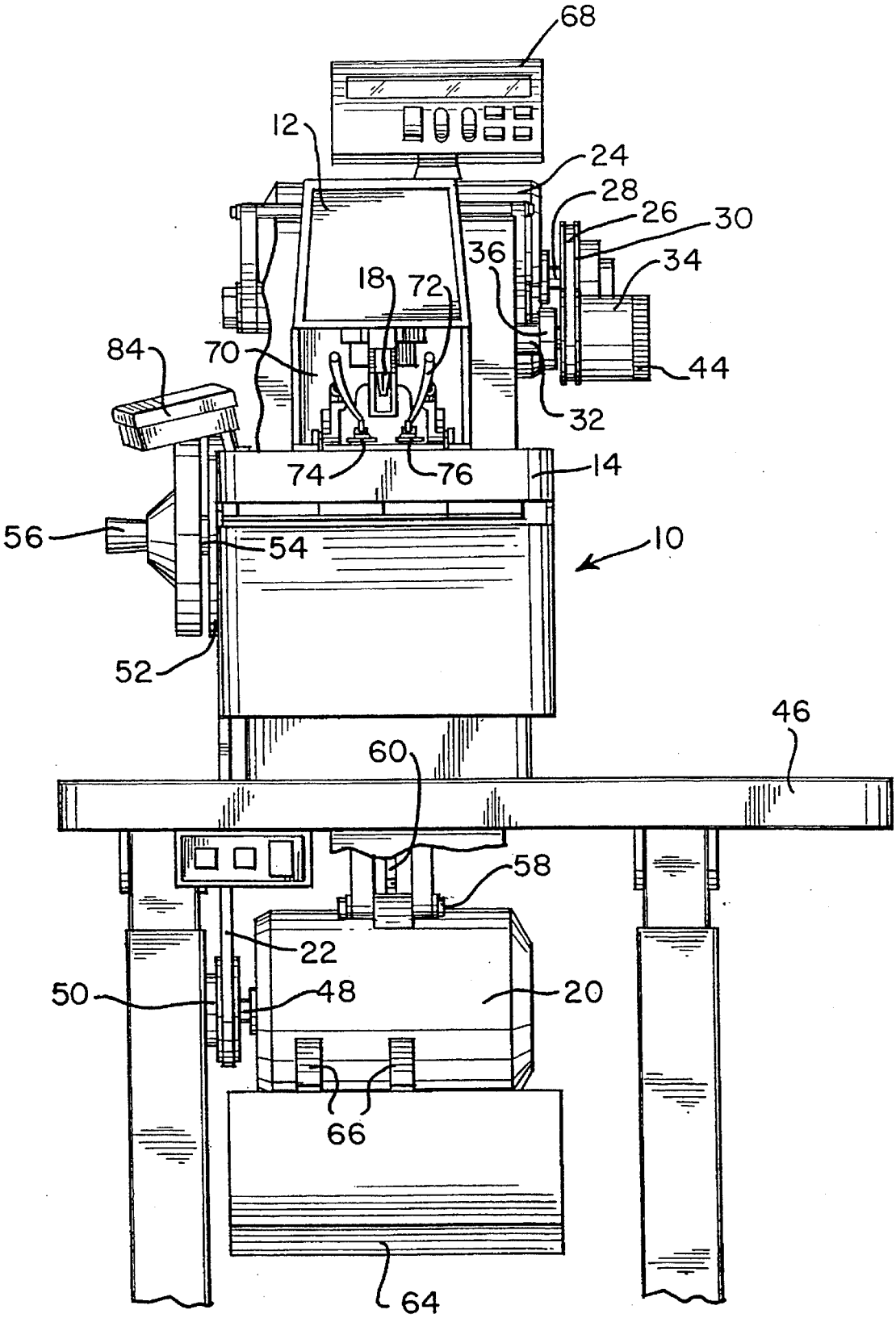
FIG. 2 is a front view of the buttonhole sewing machine illustrated in FIG. 1.

Referring now to FIG. 1, a buttonhole sewing machine 10 having a housing 12 is illustrated. This buttonhole sewing, machine is a modification and an improvement of the Reece series 104-100 buttonhole sewing machine. Accordingly, many of the parts of the present invention function similarly to the Reece machine and for the sake of brevity, the description of those parts has been omitted.

A bed plate 14 is slidably mounted on housing 12. Housing 12 comprises the fixed frame of the sewing machine. A cutting lever 16 is pivotally mounted on housing 12. Because cutting lever 16 is mounted in a conventional manner, and for the sake of clarity, cutting lever 16 will not be illustrated in the remaining drawing Figures. A needle bar mechanism 18 (see FIG. 4) is mounted on housing 12 in such a manner that it is movable up and down in a reciprocal manner with respect to housing 12.

Figure 3:
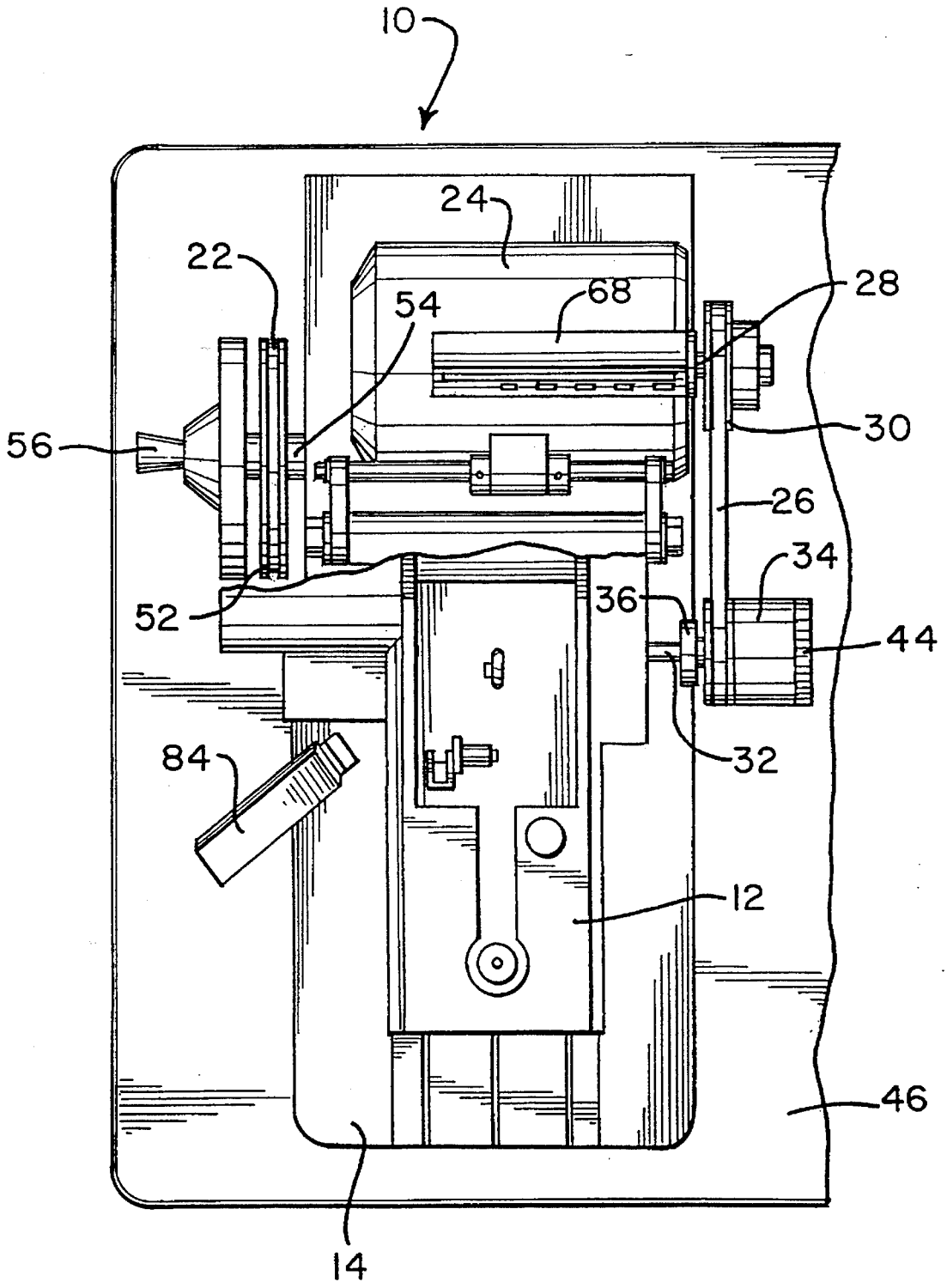
FIG. 3 is a partially sectioned top view of the buttonhole sewing machine in accordance with the present invention.

A second D.C. brushless motor 24 is mounted on housing 12. The second motor 24 directly drive the needle bar mechanism 18, via belt drive 26. As illustrated in FIG. 3, second motor 24 rotates shift 28 which is fixedly connected to pulley 30. Belt 26 transmits the rotary force from motor shaft 28 to the needle bar mechanism actuating shaft 32. Shaft 32 is fixedly connected to pulley 34 which is rotatably driven by belt 26. A cam 36 is fixedly connected to shaft 32. Cam 36 slidably engages with bed plate 14 to cause the bed plate to move about the periphery of the buttonhole to be sewn. Thus, rotation of shaft 32 causes the actuation of the needle bar mechanism 18 and simultaneously causes the bed plate 14 to move a distance substantially equal to the length of the stitch to permit the needle bar mechanism to stitch about the periphery of the buttonhole. Pulley 34 is also provided with a knurled outer periphery 44 on its opposite axial end. Knurled outer periphery 44 permits the user to manually rotate shaft 32 for maintenance purposes.

Figure 4:
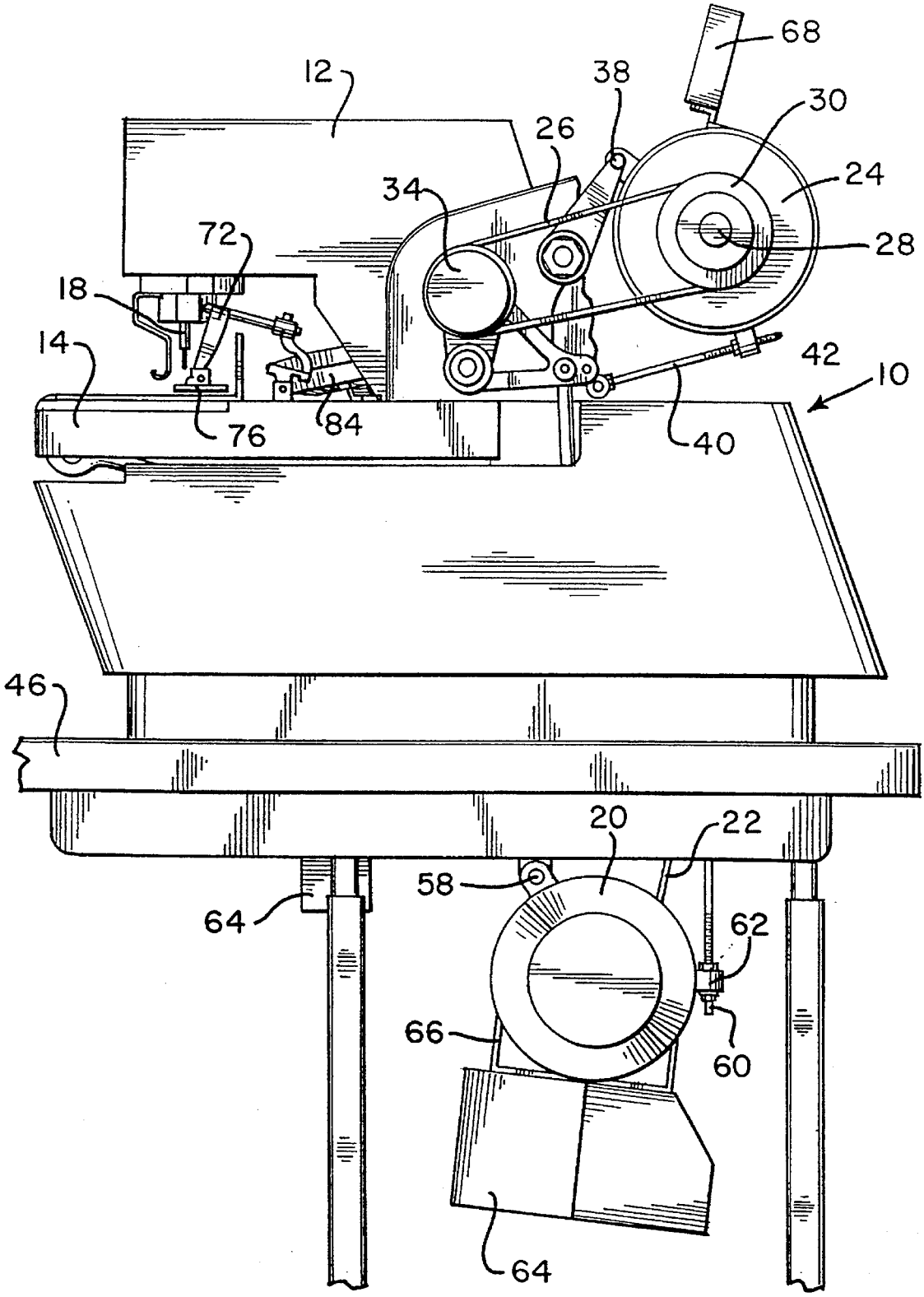
FIG. 4 is a side view of the buttonhole sewing machine in accordance with the present invention.

Referring now to FIG. 4, to adjust the tension on belt 26, motor 24 is pivotally mounted to housing 12 about pivot point 38. A threaded rod 40 receives an internally threaded mounting bracket 42 which is mounted on motor 24. Accordingly by rotating a nut within running bracket 42, motor 24 can be pivoted toward or away from housing 12 to vary the tension on belt 26 to a preferred level.

A first D.C. brushless motor 20 is mounted to housing 12 by being mounted below table 46. Motor 20 rotates shaft 48 which is fixedly connected to pulley 50. Bell 22 directly transmits the rotary force from motor shaft 48 to pulley 52 which is fixedly mounted on shaft 54. Rotation of shalt 54 actuates the mechanism (not shown) to move bed plate 14 between the home position and the sew position. In addition, handle wheel 56 is fixedly attached to shaft 54 to permit the user to manually rotate this shaft for maintenance purposes. Referring now to FIG. 4, motor 20 includes a belt tensioning adjustment mechanism similar to the mechanism used to adjust belt 26 of the first motor 24. Motor 20 is pivotally mounted to the housing 12 about pivot point 58. Threaded rod 60 receives an internally threaded mounting bracket 62 which is mounted on motor 20. Accordingly, by rotating a nut within mounting bracket 62, motor 20 can be pivoted toward or away from table 46 to vary the tension on belt 22.

A control unit 64 is mounted below motor 20 by a pair of brackets 66. An additional portion of the control unit 64, as illustrated in FIG. 1, can be mounted directly below table 46. Control unit 64 has a display 68 mounted on top of first motor 24. Control unit 64 is programmed to control the actuation of the first motor 20 and the second motor 24. Be cause the movement of the bed plate 14 between the home position, the sew position and the cutting position takes place independently of the actuation of the needle bar mechanism, it is preferred that the control unit controls the actuation of only one motor at any given time. In other words, in an operating sequence, assuming that the bed plate is in the home position, control unit 64 will actuate motor 20 to cause the bed plate to move to the sew position. Thereafter, the control unit will no longer actuate motor 20 and will begin to control the actuation of second motor 24 to beg in the stitching operation. Once the stitching operation is complete, that is, once the entire periphery of the buttonhole has been sewn, control unit 64 will stop the actuation of motor 24. Thereafter, control unit 64 will again cause actuation of motor 20 to move the bed plate 14 to the cutting position. Once the bed plate 14 is in the cutting position, cutting lever 16 is actuated to cut the buttonhole in the fabric. Thereafter, the control unit 64 actuates motor once again to move the bed plate back to the home position. It should be noted that, as is conventional with buttonhole sewing machines, the cutting step can take place either before or after the stitching process.

The operator may control the operation of the buttonhole sewing machine by inputting, via display unit 68, that the motors are to be controlled to operate through either a full cycle, a single step (to move the table only), or for a repair cycle. The full cycle for the buttonhole sewing machine is the normal operating sequence and has been described above. The single step can be used to aid a mechanic when servicing the machine by permitting the machine to advance at only one operating sequence step at a time. The repair cycle permits the operator to move the second motor 24 at various speeds. For example, the speed of motor 24 can be controlled to be between a range of 80 to 2,000 rpm, with a normal operating speed being between 1250–1500 rpm. However, by operating the second motor at the very low speed of 80 rpm, the operator can position the needle at a precise position about the buttonhole. Thus, if for any reason the stitching cycle were to be interrupted, the operator could turn off the machine correct the malfunction to the sewing machine, and then utilize the repair cycle to reposition the needle at the precise position necessary to insure that the buttonhole is properly sewn about the entire periphery. Accordingly, once the precise position about the buttonhole has been reached, the operator would then reset the control unit display to the full cycle setting to permit the buttonhole to be sewn and cut in the normal manner.

Figure 5:
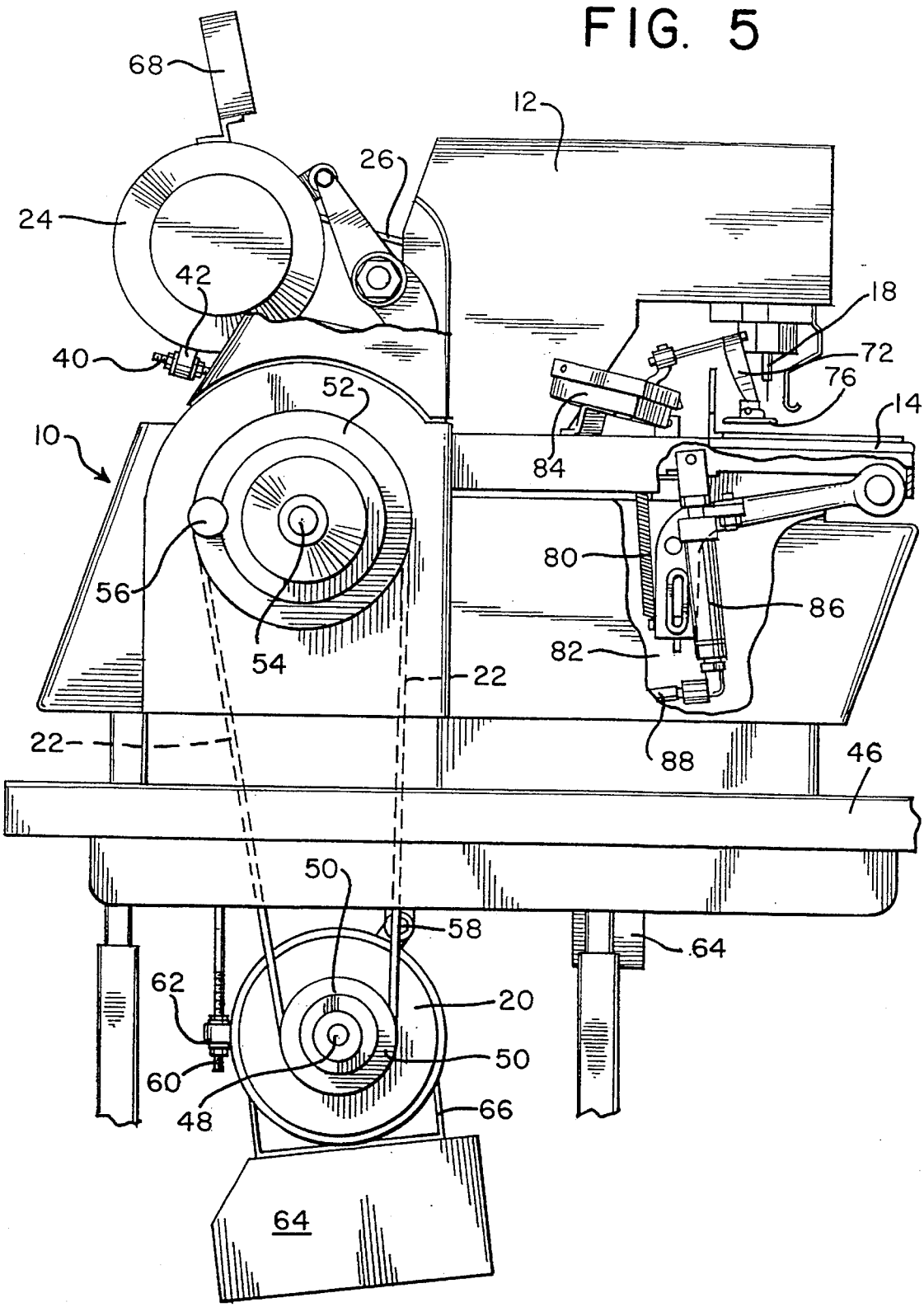
FIG. 5 is a partially sectioned side view of the present invention.
Figure 6:
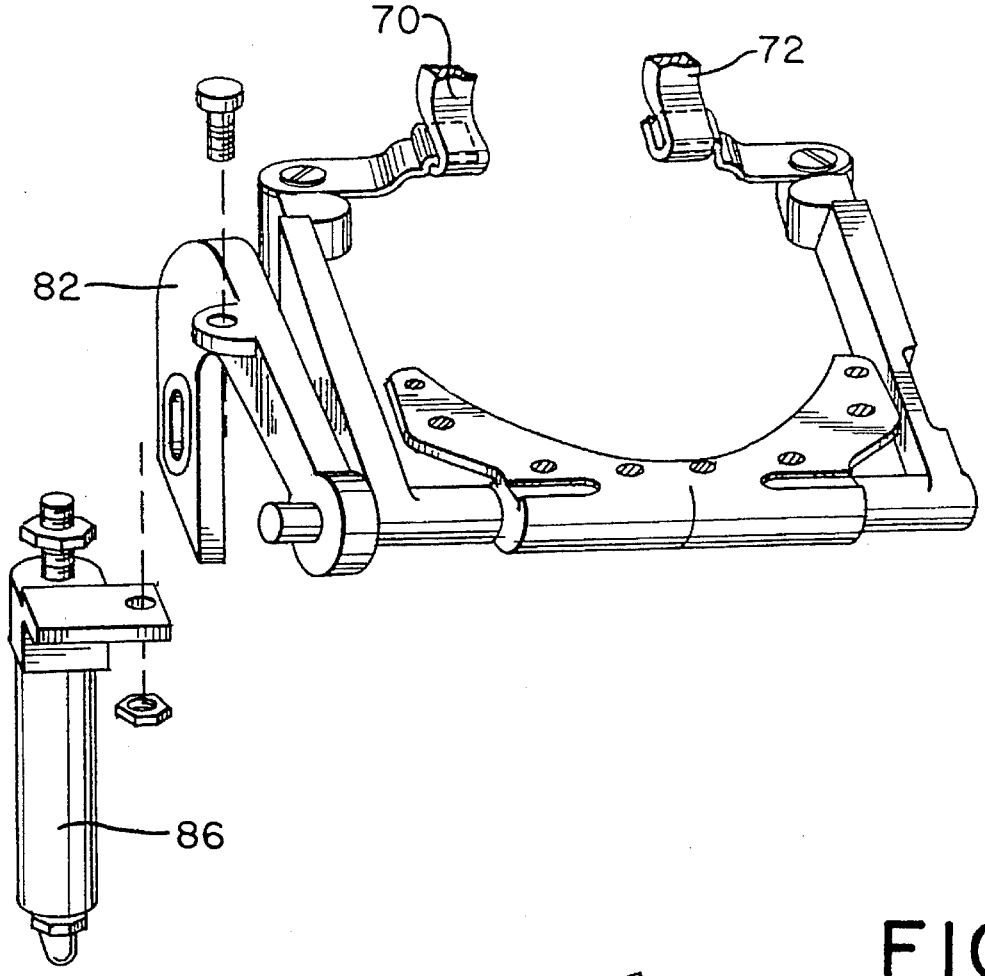
FIG. 6 is an exploded view of a clamping mechanism according to the present invention.
Figure 7:
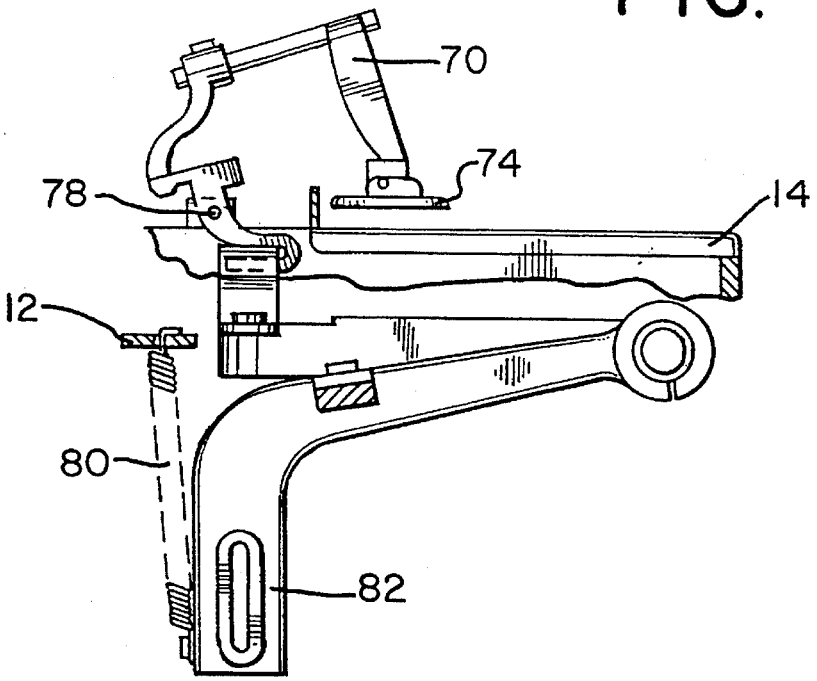
FIG. 7 is a side view of the clamping mechanism according to the present invention.

Referring now to FIGS. 2 and 4–7, a pair of clamping arms 70, 72 each has a clamping foot 74, 76 attached to their distal end. The clamping mechanism is pivotally mounted to housing 12 about pivot point 78 as illustrated in FIG. 7. A coil spring 80 is mounted between housing 12 and a distal end of clamp yoke 82. Spring 80 is in tension to thereby impart a counterclockwise (as viewed in FIG. 7) force about pivot point 78 to the clamping mechanism. According, spring 80 holds clamping feet 74, 76 in the up position. A pneumatic air cylinder 86 is connected to the clamp yokes 82 as illustrated in FIGS. 5 and 6. By actuating pneumatic switch 34, the operator will cause air pressure to enter pneumatic cylinder 86 via air pressure line 88 from an external air pressure source (not shown). The actuation of air cylinder 86 causes the clamp yoke 82 to be moved in a downward manner against the force applied from spring 80. Accordingly, the clamping arm mechanism will rotate in a clockwise direction about pivot point 78 to cause the feet 74, 76 to be brought down against the top surface of bed plate 14. Accordingly, clamping feet 74, 76 will now securely hold a fabric on the top surface of the bed plate between the clamping feet 74, 76 and the top surface of the bed plate 14. If at any time during the operating sequence, the operator wishes to adjust the position of the fabric, he or she can simply feather the actuation of switch 84 to cause feet 74, 76 to intermittently release and reapply the pressure being applied onto the fabric. In this manner, the user can reposition the fabric to a desired position without totally releasing the clamping force on the fabric. Once the fabric is in the correct position, the user will then discontinue feathering of switch 84 and permit feet 74, 76 to retain the position of the fabric securely between feet 74, 76 and the top surface of the bed plate 14.

Having described the presently preferred exemplary embodiment of a new and improved buttonhole sewing machine, in accordance with the present invention, it is believed that other modifications, variation and changes will be suggested to those skilled in the art in view of the teachings set forth herein. It is, therefore, to be understood that all such variations, modifications, and changes are believed to fall within the scope of the present invention as defined by the appended claims.

We claim:

1. A buttonhole sewing machine comprising:

a housing;

a bed plate being slidable mounted on said housing between a home position and a sew position;

a needle mechanism mounted on said housing and being movable in a reciprocal manner with respect to said housing;

a first motor mounted on said housing, said first motor directly driving said bed plate between said home position and said sew position; and a second motor mounted on said housing, said second motor directly driving said needle mechanism, said second motor having means for directly driving said bed plate to permit stitching about a buttonhole.

2. A buttonhole sewing machine according to claim 1 further including a control unit having means for controlling the actuation of said first motor and said second motor.

3. A buttonhole sewing machine according to claim 2, wherein said controlling means controls the actuation of only one of said first motor and said second motor at any given time.

4. A buttonhole sewing machine according to claim 2, wherein said controlling means controls the actuation of said second motor between a rotational speed ranging from 80 rpm to 2000 rpm.

5. A buttonhole sewing machine according to claim 1 further including a clamping arm having means for selectively holding a fabric securely on a top surface of said bed plate.

6. A buttonhole sewing machine according to claim 5, wherein said selective holding means is pneumatically actuated.

7. A buttonhole sewing machine according to claim 6, wherein said holding means includes a switch mounted on said top surface of said bed plate.

8. A buttonhole sewing machine according to claim 1, wherein said direct driving means includes a cam being mounted on a rotating shaft to effect a movement of said bed plate about a periphery of said buttonhole.

9. A buttonhole sewing machine according to claim 2, wherein said first motor and said second motor are electric motors.

10. A buttonhole sewing machine according to claim 9, wherein said electric motors are rotary encoded D.C. brushless motors.

* * * * *